US009708824B2

(12) United States Patent
Thompson

(10) Patent No.: US 9,708,824 B2
(45) Date of Patent: Jul. 18, 2017

(54) UNIVERSAL SWIMMING POOL MAIN DRAIN ADAPTOR

(71) Applicant: Steven E Thompson, Brooksville, FL (US)

(72) Inventor: Steven E Thompson, Brooksville, FL (US)

( * ) Notice: Subject to any disclaimer, the term of this patent is extended or adjusted under 35 U.S.C. 154(b) by 40 days.

(21) Appl. No.: 14/842,741

(22) Filed: Sep. 1, 2015

(65) Prior Publication Data

US 2016/0153209 A1 Jun. 2, 2016

Related U.S. Application Data

(60) Provisional application No. 62/070,955, filed on Sep. 11, 2014.

(51) Int. Cl.
*E04H 4/14* (2006.01)
*E04H 4/12* (2006.01)

(52) U.S. Cl.
CPC ..... *E04H 4/1236* (2013.01)

(58) Field of Classification Search
CPC ..... E04H 4/1236; E04H 4/12; E04H 4/1209; E04H 4/16; E03C 1/26; E03C 1/264; A61H 33/6068; A61H 33/6073; A61H 33/6078; E03F 5/04; E03F 5/0407; E03F 5/0408; E03F 5/0409; E03F 5/0401; E03F 5/0402; E03F 5/0403; E03F 5/06; E03F 2005/0412; E03F 2005/0413; E03F 2005/0415; E03F 2005/063; E03F 2005/066
USPC ..... 4/504, 507, 695
See application file for complete search history.

(56) References Cited

U.S. PATENT DOCUMENTS 2,400,070 A * 5/1946 Boosey ..... E03C 1/26 210/165
2,749,999 A * 6/1956 Schmid ..... E03F 5/0407 137/362
2,948,399 A * 8/1960 Sisk ..... E03F 5/0407 210/166
3,378,858 A 4/1968 Candido
3,940,807 A * 3/1976 Baker ..... A61H 33/6073 210/167.1
4,658,449 A 4/1987 Martin
6,387,261 B1 * 5/2002 Mojena ..... B01D 24/008 210/315
6,817,043 B2 11/2004 Zars
7,603,752 B2 10/2009 Heath
(Continued)

*Primary Examiner* — J. Casimer Jacyna

(57) ABSTRACT

A transitional mounting adaptor to connect a pool main drain to a pool main drain cover with or without water in the pool. The adaptor consists of a trim ring with four cardinal point screw slots (NSEW) molded to a perpendicular mounting ring with three equally spaced, threaded pointed thumb screws, passing perpendicularly thru the mounting ring, via a series of threaded mounting holes, creating three pressure points which secures the adaptor to the main drain pot. The cardinal point screw slots in any position will receive coarse thread main drain screws used for mounting a main drain cover onto the trim ring. Further, the edge of the trim ring is bull-nosed. The cardinal point screw slots of the trim ring can also be used to mechanically fasten the adaptor to a main drain pot. The adaptor allows water to pass thru the trim ring, thru the mounting ring, and continue thru the main drain, as with the normal functioning of pool water flow.

15 Claims, 4 Drawing Sheets

(56) References Cited

U.S. PATENT DOCUMENTS

| | | | | |
|---|---|---|---|---|
| 8,191,330 | B1 * | 6/2012 | Cornwall | E03F 5/0407 52/220.8 |
| 8,403,513 | B2 | 3/2013 | Drury | |
| 8,628,657 | B1 * | 1/2014 | Robillard | E03F 5/0407 210/163 |
| 9,222,274 | B1 * | 12/2015 | Goettl | E04H 4/16 |
| 9,540,837 | B2 * | 1/2017 | Mjelde | E04H 4/1236 |
| 2002/0148039 | A1 * | 10/2002 | Minnick | E03F 5/0407 4/613 |
| 2004/0093666 | A1 | 5/2004 | Zars | |
| 2005/0196238 | A1 * | 9/2005 | DeGreef | E03F 5/06 404/25 |
| 2007/0034577 | A1 * | 2/2007 | Bayard | E03F 5/06 210/767 |
| 2013/0039037 | A1 | 2/2013 | Drury | |

* cited by examiner

UNIVERSAL SWIMMING POOL MAIN DRAIN ADAPTOR

STATEMENT REGARDING FEDERALLY SPONSORED RESEARCH/DEVELOPMENT

Not Applicable.

BACKGROUND OF INVENTION

1. Technical Field

This invention relates to swimming pools, spas, fountains, ponds and more particularly to the main drains and main drain covers of any body of water utilizing a pump and circulation system that uses a main drain pot.

2. Discussion of the Background

Most swimming pools, spas, fountains and ponds utilizing a pump and circulation system that uses a main drain pot, whether in-ground or above ground, constructed of concrete, fiberglass or a vinyl liner, have a drain at the lowest elevation of the floor. The purpose of the drain is to circulate water from the bottom of the pool thru piping to the suction side of a pump, to then be returned back into the pool after passing thru a filtration system, thru return outlets in the upper level of the body of water. The main drain consists of a pot that traps debris and a connected suction line that includes a trapping basket at the pump to collect any debris that has passed thru the suction line. The main drain includes a grated cover that allows water to pass thru, but screens larger items from passing thru the suction line and potentially clog the system.

On occasion, the screws that mechanically fasten the main drain cover to the main drain pot become compromised from rust, due to poor water chemistry. The main drain cover can no longer be mechanically fastened to a main drain pot. The thread section of the screws can become lodged in the female receiving screw holes of the main drain pot. This requires the pool to be drained and the rusted remains of the screw to be tapped out. Also, depending on the brand and year of manufacture, the screw patterns of newer main drain covers often do not match the screw patterns of older main drain pots. These two previously stated conditions can make the ability to change a main drain cover to a Virginia Graeme Baker Pool & Spa Safety Act compliant cover, or even have a cover mounted at all, very prohibitive. Not having a main drain cover on a swimming pool, spa, fountain or pond is hazardous and life threatening.

Accordingly, there is a need for a method of securing a main drain cover on a swimming pool, spa, fountain or pond when it otherwise is difficult or impossible to do so. It is to this need that this present invention is directed.

In other Prior Art, such as Patent US20040093666, an apparatus consisting of an adapter and a main drain cover, with some similar embodiments to the present invention, is presented. The said apparatus utilizes a three pressure point mounting element in an attempt to solve the same problem that the present invention addresses.

This mounting method is found as well in other Prior Art such as U.S. Pat. Nos. 8,403,513 B2, and 7,603,752 B2, as well as others not listed. In Patent US20040093666, the author uses a much thicker wall mounting ring element replete with upper and lower passage cut-outs for water flow that also act as mounting points for a cover element. The mounting screws employed to attach to apparatus to a main drain are of a standard bolt design. The present invention is more utilitarian in design, possessing a thinner mounting wall and does not need to have the upper element mechanically fastened and further, does not require water flow cut-outs. Further, the present invention uses thumb-style mounting screws, for ease of installation. In the Prior Art apparatus, only one row of mounting holes for the mounting adapter is offered in the design. The reality of an in-field application of any apparatus into an actual main drain consist of many variables, such as how many times a mud ring has been used during the application of new pool surfaces, or the type, style or contours of an existing main drain. Thus this Prior Art would be impractical as a dependable mounting design. Further, the method by which this Prior Art would be installed, is suspect and overly complex, since pool surfaces are not necessarily flat or even, thus requiring great excess care in setting the proper elevation of the said mounting adapter to enable the cover element to be secured properly. The present invention bypasses these issues by possessing the preferred embodiment of having multiple elevations of mounting holes, and being that the present invention is one molded apparatus, and has the embodiment of seating into a main drain flush against an existing pool surface, with minimal skill level required for installation. Most importantly, the present invention is not a main drain cover that mounts by somewhat similar means, but simply a transitional adaptor between a cover and a main drain utilizing a plurality of various, optional elevation points, with the further preferred embodiment of cardinal point slots capable of receiving any sized, circular residential main drain cover, regardless of screw spacing or of availability of a screw receiver, within the main drain. Therefore, any future alteration or improvement in the field of safety main drain covers may be adaptable in conjunction with the present invention.

In U.S. Pat. No. 8,403,513 B2, the Prior Art utilizes a somewhat similar pressure point mounting system thru a compression band. The present invention employs compression points thru a plastic mounting ring comprised of a plurality of various, optional elevation points. Further, the present invention also uses thumb-style mounting screws, for ease of installation.

After review of the background, summary, and detailed description of the preferred embodiments, in conjunction with the drawings, specifications and claims, it should be apparent to anyone skilled in the field of Prior Art, that the present invention uniquely solves the need for a method of securing a main drain cover on a swimming pool, spa, fountain or pond when it otherwise is difficult or impossible to do so.

SUMMARY

A universal swimming pool main drain adaptor is an intermediate, transitional mounting adaptor to connect an existing swimming pool main drain to an existing or new swimming pool main drain cover on any body of water utilizing a pump and circulation system that uses a main drain pot, such as a swimming pool, spa, fountain or pond. The adaptor consists of a plastic trim ring with four cardinal point screw slots molded to a perpendicular, plastic mounting ring with three equally spaced, threaded stainless steel or plastic, pointed mounting thumb screws, passing perpendicularly thru the mounting ring in threaded holes, creating three pressure points. The slots in any position will receive a standard stainless steel coarse thread main drain screw. Having no main drain cover or a damaged main drain cover can be very dangerous. Not having the ability to mount a Virginia Graeme Baker Pool & Spa Safety Act compliant cover is also very dangerous. This present invention will allow a main drain cover and/or a compliant main drain cover to be mounted on a main drain pot when screw holes on an existing main drain are blocked via remains of rusted screws; this adaptor mounts without using existing screw holes so that the existing main drain cover or a new main drain cover can be mechanically fastened back on. The universal swimming pool main drain adaptor may be installed with or without water in the pool.

One preferred embodiment of the present invention is the four cardinal point slots of the trim ring that allow an existing main drain cover, regardless of its screw spacing or pattern, to be mounted onto the trim ring at any point along the cardinal point slots. Further, the preferred embodiment of the manner by which the mounting ring allows the present invention to be secured into an existing main drain pot, regardless of the availability of access to mounting points on an existing main drain pot, adds to the safety benefits of the present invention.

Prior to this invention, no method existed to mechanically refasten an existing, or fasten a new, main drain cover, onto an existing main drain pot, with the aforementioned damages. Many homeowners and pool professionals would often simply neglect the issue, leaving a hazardous condition unresolved.

A complete understanding of the present invention may be obtained by examination of the accompanying drawings when considered in conjunction with the detailed description of the preferred embodiments.

BRIEF DESCRIPTION OF THE DRAWINGS

In the figures, similar reference numbers refer to similar parts typical through various figures unless noted otherwise. Numerals with letter characters in addition to numerals such as "101A" or "101B" the letter character designations for reference numerals indicates that two similar parts or elements are present in the same figure. Letter character designations for reference numerals may be omitted when it is intended that a reference numeral encompass all parts having the same reference numeral in all figures.

For a more complete understanding of the present invention, and for further details and advantages thereof, reference is now made to the following detailed description taken in conjunction with the following drawings, in which.

DETAILED DESCRIPTION OF THE PREFERRED EMBODIMENTS

Figure 1:
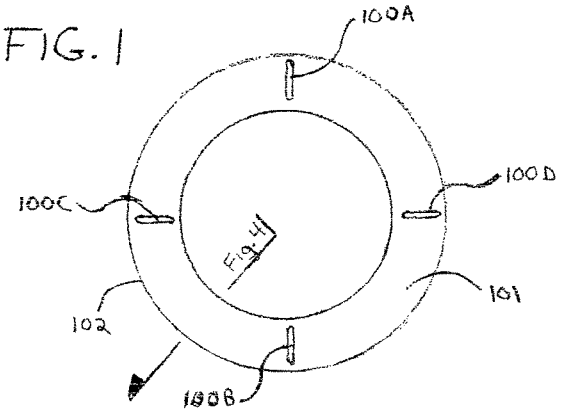
FIG. 1 is an overhead view of the top view of the universal swimming pool main drain adaptor, specifically the top view of the trim ring and includes a cut sectional reference to FIG. 4.

In the descriptions which follow, like parts are marked throughout the specification and drawings with the same numerals, respectively. The drawing figures are not necessarily drawn to scale and certain figures may be shown in exaggerated or generalized form in the interest of clarity and conciseness.

Various elements, features and benefits of the embodiments on the present invention will be more apparent with regard to the following description in conjunction with the included drawings. Those skilled in the art that the described embodiments of the present invention included herein are illustrative only and not limiting, and are presented in the way of example only. The features represented in this description may only be substituted with alternate features serving same or similar purposes, unless otherwise expressed. Therefore, other embodiments of modifications thereof are contemplated as falling within the scope of present invention defined herein and equivalents thereto. Presently disclosed embodiments, as well as features and properties thereof, are directed to provide an adaptor for a main drain and method of installation. It should also become apparent from reviewing the drawings and descriptions, exemplary embodiments may allow user to easily secure the universal swimming pool main drain adaptor to a main drain pot 110 and easily secure a main drain cover 104 to said adaptor. A person of ordinary skill in the art will recognize the embodiments of the universal swimming pool main drain adaptor may be employed when it would otherwise be prohibitive to properly secure a main drain cover 104 by mechanically fastening to a main drain pot 110. In referring to the drawings of the invention of the universal swimming pool main drain adaptor:

FIG. 1 is an overhead view of the top view of the universal swimming pool main drain adaptor depicting the preferred embodiment of the four cardinal point slots 100A, 100B, 100C and 100D oriented as North, South, East and West, respectively. The cardinal slots 100A, 100B, 100C and 100D receive the main drain screws 103A and 103B that secure an existing or new main drain cover 104. The aforementioned slots are within the body of the trim ring 101 which is bull-nosed 102 on the outer top edge as typical. The cardinal point slots 100 can securely maintain their integrity around a fastened main drain screw 103, at and point along the pathway of the cardinal point slot 100 to accommodate any spacing pattern of a main drain cover 104. FIG. 1 also depicts a cross section reference that is represented by FIG. 4.

Figure 2:
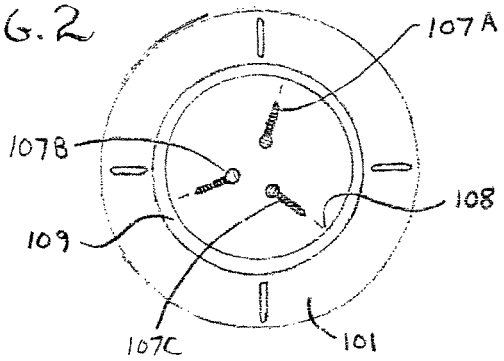
FIG. 2 is an underside view of the bottom view of the universal swimming pool main drain adaptor, specifically of the bottom view of the trim ring and the edge view of the mounting ring including the mounting screws in proper orientation.

FIG. 2 is an underside view of the bottom view of the universal swimming pool main drain adaptor inclusive of the underside of the trim ring 101 and the bottom edge of the mounting ring 109. A second preferred embodiment of the pointed mounting screws, 107A, 107B and 107C, are shown in their proper orientation in line to be threaded thru the mounting ring 109 perpendicularly, spaced at ⅓ intervals, into the threaded mounting holes 108 typical.

Figure 3:
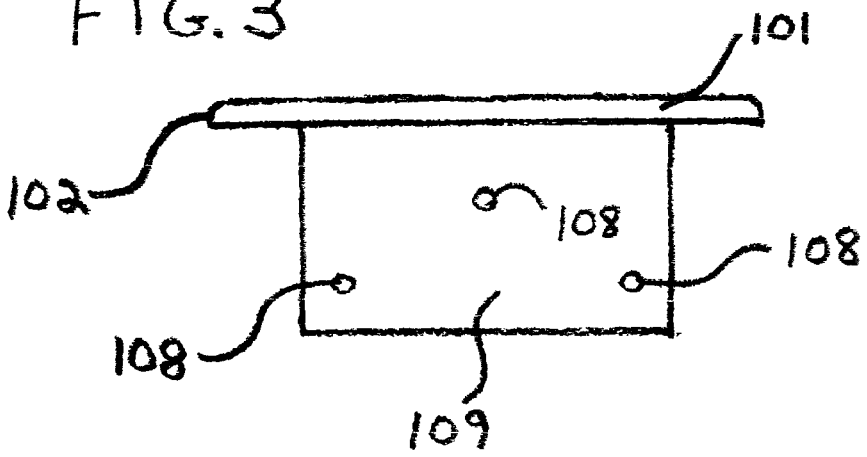
FIG. 3 is an elevation view of the profile of the universal swimming pool main drain adaptor showing the edge view of the trim ring, the side view of the mounting ring, and partial view of 3 mounting screw thread holes.

FIG. 3 is an elevation view of the profile, at one specific point, of the universal swimming pool main drain adaptor, whereas the edge of the trim ring 101 including view of trim ring bull-nosed 102 edge is shown. Further, a view of the mounting ring 109 showing another of the preferred embodiments, several threaded mounting ring holes 108 typical, shown in two offset rows. Mounting holes 108 are not limited to this depiction, but carry around the body of the mounting ring 109 in at least, but not limited to a two-row offset pattern, set in equal thirds spacing.

Figure 4:
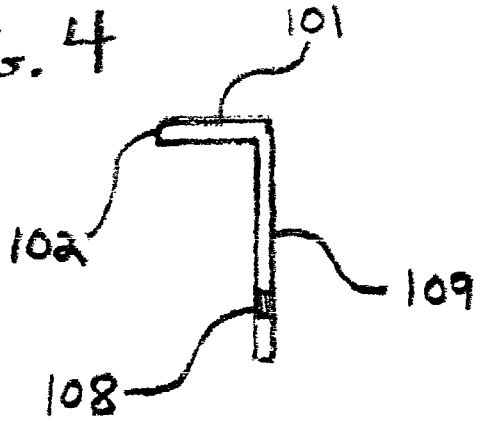
FIG. 4 is a sectional view of the universal swimming pool main drain adaptor showing one perspective of the trim ring and mounting ring.

FIG. 4 is a sectional view, at one specific point, of the universal swimming pool main drain adaptor depicting two adjacent edges, one edge of the trim ring 101 and one edge of the mounting ring 109. Also depicted at this specific sectional point is the embodiment of one specific mounting hole 108 in the mounting ring 109.

Figure 5:
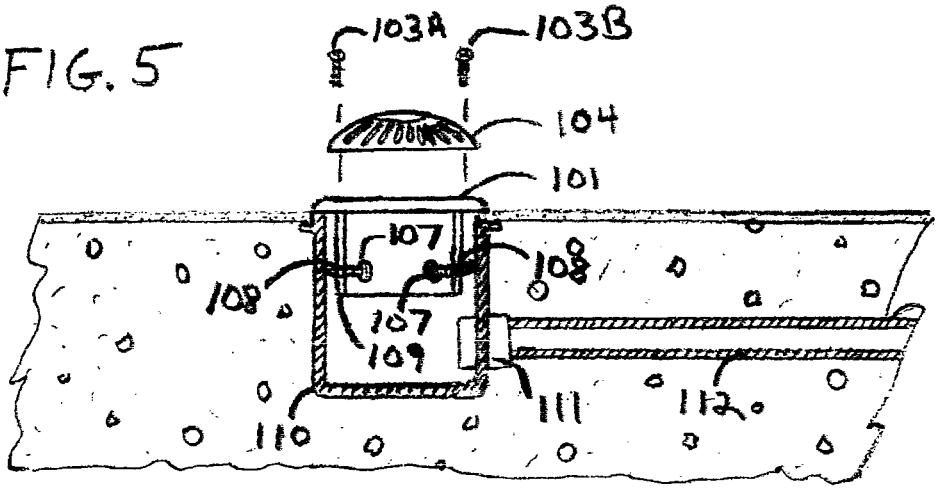
FIG. 5 is a partially exploded sectional view of a swimming pool, a swimming pool main drain and the universal swimming pool main drain adaptor and elements of the universal swimming pool main drain adaptor as mounted with exploded mounting of a sample main drain cover.

FIG. 5 is a partially exploded sectional view at one specific point of the universal swimming pool main drain adaptor depicting the view of the adaptor in its mounted state with an exploded view of an existing or new main drain cover 104 in a mounting orientation. The exploded view of an existing or new main drain cover 104 shows the two pointed stainless steel main drain screws 103A, 103B in a mounting orientation consistent with the pathway in which the pointed stainless steel mounting screws 103A, 103B will intersect and connect an existing or new main drain cover 104 to the bull-nosed edged 102 trim ring 101 via the cardinal point slot 100 not visible in this view. Also depicted at one specific point are two of the three pointed mounting screws 107 as they pass thru the threaded mounting holes 108 of the mounting ring 109 to create pressure points against an existing main drain pot 110. A main drain pot 110 has a molded connector 111 to fasten a plumbing line 112 that leads to the suction side of a pump.

Figure 6:
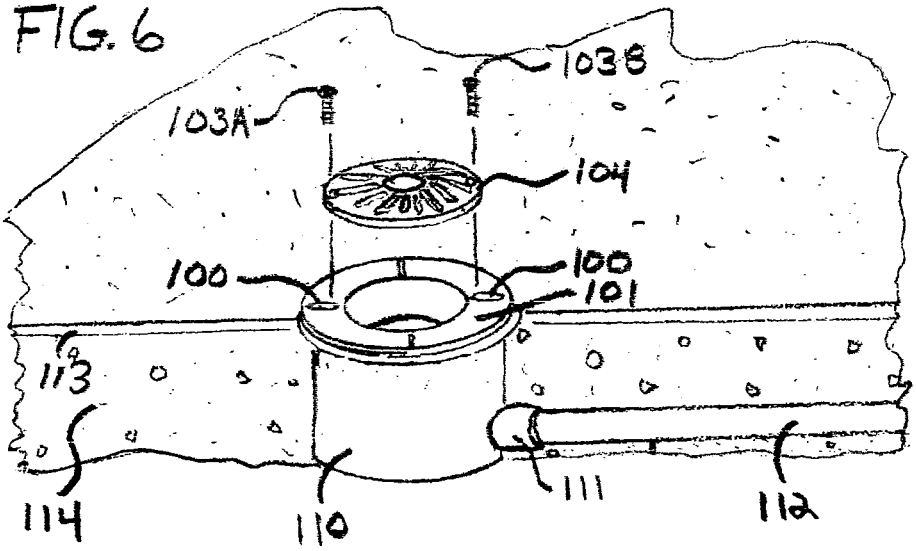
FIG. 6 is a partially exploded sectional perspective view of the universal swimming pool main drain adaptor mounted in an existing pool main drain with exploded view of a sample main drain cover in mounting orientation.

FIG. 6 is a partially exploded sectional perspective view of the universal swimming pool main drain adaptor seated in an existing main drain pot 110 set flush onto an existing pool surface material 113 laid over a concrete pool shell 114. The view of a main drain pot 110 is an exterior orientation depicting a plumbing connector 111 to a plumbing line 112. Also depicted is an exploded view of a main drain cover 104 in a mounting orientation with pointed stainless steel main drain screws 103A and 103B in a mounting orientation consistent with the pathway in which the stainless steel main drain screws 103A and 103B will intersect and connect an existing or new main drain cover 104 to the trim ring 101 via cardinal point mounting slots 100.

Figure 7:
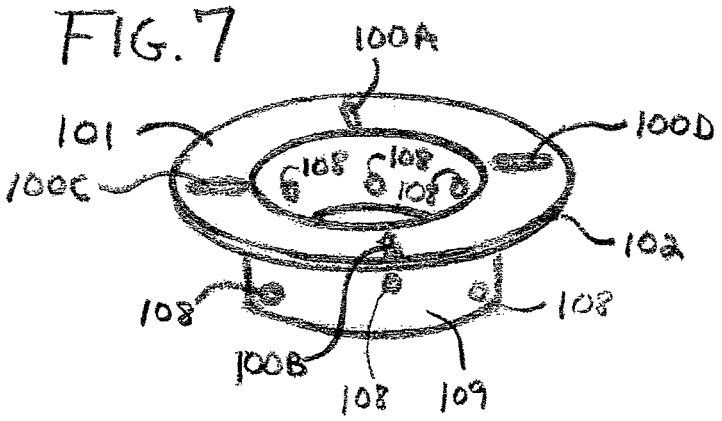
FIG. 7 is a perspective view of the universal swimming pool main drain adaptor.

FIG. 7 is a perspective view of the universal swimming pool main drain adaptor showing a trim ring 101 with bull-nosed edge 102 with four cardinal point slots 100A, 100B, 100C and 100D. Also depicted is the mounting ring 109 with several mounting holes 108 visible from this perspective. Not all mounting holes 108 are visible from this perspective.

The invention claimed is:

1. A universal swimming pool main drain adaptor is a transitional mounting adaptor that is adapted for connecting an existing swimming pool main drain to a swimming pool main drain cover, comprising: a main drain cover, at least 2 threaded main drain screws and a trim ring with at least 2 cardinal point screw slots that receive said thread main drain screws to attach said main drain cover to said trim ring; secured to said trim ring and perpendicular to said trim ring is a mounting ring with at least three equally spaced, threaded holes; and passing thru said threaded holes and perpendicularly thru said mounting ring are at least three mounting thumb screws that create at least three pressure points which are adapted to secure said universal swimming pool main drain adaptor onto an existing main drain pot.

2. A universal swimming pool main drain adaptor of claim 1, wherein the trim ring, comprises a round donut shaped trim ring with four cardinal point slots (NSEW), and receives plastic or stainless steel coarse thread screws at any point along any slot to securely fasten a main drain cover to the trim ring.

3. A universal swimming pool main drain adaptor of claim 1, wherein the mounting ring has three equally spaced threaded holes on the lower portion of the mounting ring and three equally spaced holes on the upper portion of the mounting ring to offer two optional elevations in which the mounting screws can be used to secure the universal swimming pool main drain adaptor onto an existing main drain pot.

4. A universal swimming pool main drain adaptor of claim 3, wherein the upper three equally spaced threaded holes are offset from the three lower equally spaced threaded holes.

5. A universal swimming pool main drain adaptor of claim 1, wherein the three thumb screws are made of stainless steel.

6. A universal swimming pool main drain adaptor of claim 1, wherein the three thumb screws are made of plastic.

7. A universal swimming pool main drain adaptor of claim 1, wherein the trim ring has a bull-nosed edge.

8. A universal swimming pool main drain adaptor of claim 1, wherein the cardinal point slots (NSEW) pass all the way thru the trim ring.

9. A universal swimming pool main drain adaptor of claim 1, wherein the adaptor may be installed to a main drain pot with or without water in a swimming pool, spa, fountain or pond.

10. A universal swimming pool main drain adaptor of claim 1, wherein the adaptor is an intermediate transitional adaptor between a swimming pool main drain cover and a swimming pool main drain pot.

11. A universal swimming pool main drain adaptor of claim 1, wherein water is allowed to pass thru the trim ring, thru the mounting ring and continue thru the main drain as with normal functioning of pool water flow utilizing a pump and circulation system that uses a main drain pot, wherein said water flow occurs in a swimming pool, spa, fountain or pond.

12. A universal swimming pool main drain adaptor of claim 3, wherein the mounting ring screw holes pass all the way thru the mounting ring.

13. A universal swimming pool main drain adaptor of claim 1, wherein the mountain ring has three offset rows of three equally spaced mounting holes.

14. A universal swimming pool main drain adaptor of claim 1, wherein the main drain cover is a Virginia Graeme Baker Pool and Spa Safety Act compliant cover.

15. A universal swimming pool main drain adaptor of claim 1, wherein the screw pattern of the main drain cover does not match the screw pattern of the main drain pot.

* * * * *